US012252967B1

(12) United States Patent
Greci et al.

(10) Patent No.: US 12,252,967 B1
(45) Date of Patent: Mar. 18, 2025

(54) METHODS TO REGULATE DOWNHOLE FLUID FLOW THROUGH A PLURALITY OF VALVES AND DOWNHOLE FLUID FLOW REGULATION SYSTEMS

(71) Applicant: Halliburton Energy Services, Inc., Houston, TX (US)

(72) Inventors: Stephen Michael Greci, Carrollton, TX (US); Julia Mosina, Kingwood, TX (US); Graham Baines, Abingdon (GB); Brad Robert Bull, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/236,790

(22) Filed: Aug. 22, 2023

(51) Int. Cl.
*E21B 43/12* (2006.01)

(52) U.S. Cl.
CPC ..... *E21B 43/12* (2013.01); *E21B 2200/02* (2020.05)

(58) Field of Classification Search
CPC ..... E21B 43/12; E21B 2200/02
See application file for complete search history.

(56) References Cited

U.S. PATENT DOCUMENTS 6,668,922 B2 12/2003 Ziauddin et al.
9,187,991 B2 * 11/2015 Fripp ..... E21B 43/12
10,989,024 B2 4/2021 Fripp et al.
11,105,183 B2 8/2021 Frosell et al.
11,614,756 B2 3/2023 Greci et al.
2007/0095528 A1 5/2007 Ziauddin et al.
2012/0273186 A1 11/2012 Ramakrishnan et al.
2013/0048301 A1 * 2/2013 Gano ..... E21B 34/08 166/321
2014/0338899 A1 11/2014 Entchev et al.
2018/0334871 A1 * 11/2018 Cooper ..... E21B 34/12
2021/0140288 A1 * 5/2021 Lisk ..... E21B 34/16
2021/0230973 A1 7/2021 Montero Fernandez
2022/0145738 A1 5/2022 Johnson et al.

OTHER PUBLICATIONS

International Search Report and Written Opinion for PCT/US2023/031578 mailed May 13, 2024.

* cited by examiner

*Primary Examiner* — Taras P Bemko
(74) *Attorney, Agent, or Firm* — The Hilton Firm PLLC

(57) ABSTRACT

Regulating downhole fluid flow through a plurality of valves to treat wellbore sections while also allowing for production to continue. If it is determined that fluid flow through a valve of a plurality of valves is below a threshold, maintaining fluid flow through the below threshold valve may be maintained while restricting fluid flow through other valves of the plurality. This restriction fluidly isolates a section of a well from other sections of the well. Once isolated, a treatment substance may be injected through the below threshold valve into the isolated section of well. Afterwards, the closed valves may be reopened while restricting fluid flow through the treated section valve for a threshold period of time. the treated section valve may then be reopened after the threshold period of time.

20 Claims, 6 Drawing Sheets

METHODS TO REGULATE DOWNHOLE FLUID FLOW THROUGH A PLURALITY OF VALVES AND DOWNHOLE FLUID FLOW REGULATION SYSTEMS

BACKGROUND

The present disclosure relates generally to methods to regulate downhole fluid flow through a plurality of valves and downhole fluid flow regulation systems.

Scale and other types of undesirable deposits sometimes reduce ultimate hydrocarbon recovery. Although chemical treatments are sometimes performed to remove scale and other undesirable deposits, chemical treatment means are often inefficient at placing the chemicals at the precise location of the deposits, and often require a well to be shut in for several days in order for the chemicals to take effect. The foregoing contribute to inefficient chemical usage as well as loss of hydrocarbon production during the extended shut-in periods.

BRIEF DESCRIPTION OF THE DRAWINGS

Illustrative embodiments of the present disclosure are described in detail below with reference to the attached drawing figures, which are incorporated by reference herein, and wherein.

Figure 1:
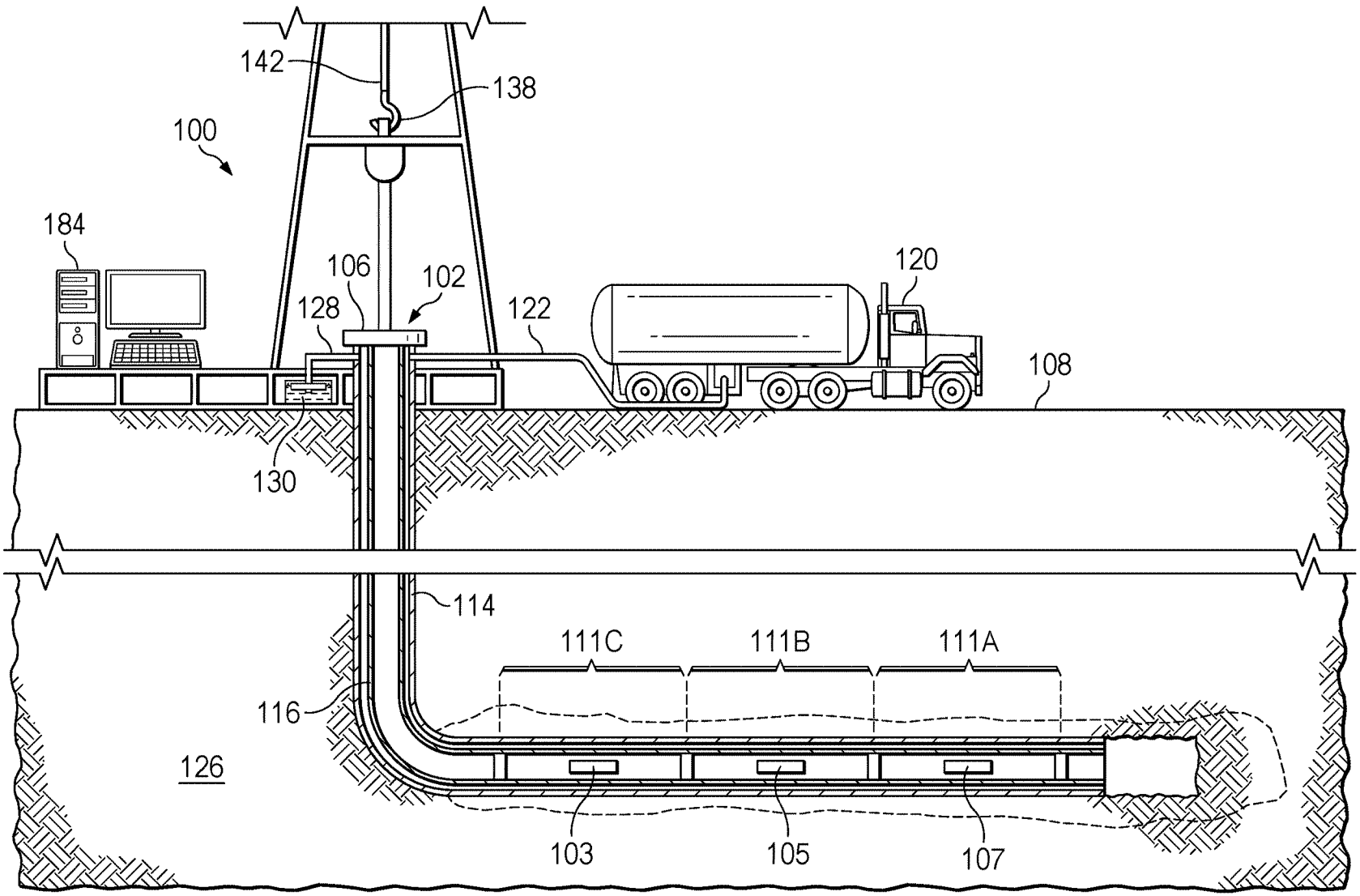
FIG. 1 is a schematic, side view of a well environment where a downhole fluid flow regulation system is deployed.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to methods to regulate downhole fluid flow through a plurality of valves and downhole fluid flow regulation systems. A downhole fluid flow regulation system includes multiple valves disposed across different sections (e.g., zones) of a well. Examples of valves include, but are not limited to, inflow control devices (ICDs), electronic inflow control devices (eICDs), autonomous inflow control devices (AICDs), and other types of devices and components configured to control fluid flow. As referred to herein, a section is any portion of a well where fluid flow through the section is controlled by one or more valves described herein. In some embodiments, where a section represents a zone, one or more valves are positioned within the zone to control fluid flow through the zone. In some embodiments, where a section represents a joint (e.g., screen joint), an eICD is placed at each screen joint to individually control fluid flow through the respective screen joint.

The downhole fluid flow regulation system (one or more processors of the downhole fluid flow regulation system) is configured to determine fluid flow through a plurality of valves. For example, where the downhole fluid flow regulation system is monitoring a well having five zones, each zone corresponding to a section that is fluidly connected to a corresponding valve, the downhole fluid flow regulation system continuously and/or periodically monitors fluid flow through the valves that provide fluid flow through the five zones of the well.

In some embodiments, each valve is configured to monitor fluid flow through the respective valve and provide data indicative of fluid flow to the downhole fluid flow regulation system. In some embodiments, the downhole fluid flow regulation system includes or is communicatively connected to fluid flow sensors/measurement devices that are configured to measure fluid flow through the valves, and provide data indicative of fluid flow through the valves to the downhole fluid flow regulation system. In some embodiments, the valves and or other components of the downhole fluid flow regulation system are configured to dynamically monitor and measure fluid flow through the valves and provide the downhole fluid flow regulation system with real-time measurements of fluid flow through the valves.

The downhole fluid flow regulation system continuously and/or periodically analyzes fluid flow data to determine whether fluid flow through a valve is less than a threshold flowrate, where fluid flow less than the threshold flowrate is indicative of particle buildup within the corresponding section, or other issues that contribute to a slowdown of fluid flow through the section. In some embodiments, the downhole fluid flow regulation system is configured to determine fluid flow through the valves over a threshold period of time (e.g., one hour, one day, one week, or another period of time). In one or more of such embodiments, the downhole fluid flow regulation system determines that fluid flow through the valve is below the threshold if fluid flow through the valve over the threshold period of time (e.g., one hour, one day, one week, or another period of time) is below the threshold.

The downhole fluid flow regulation system, in response to a determination that the fluid flow through a valve is below the threshold, maintain fluid flow through the valve while restricting fluid flow through other valves to fluidly isolate a section of a well that is fluidly connected to the valve from other sections of the well that are fluidly connected to the other valves. Continuing with the foregoing example, the downhole fluid flow regulation system, in response to a determination that fluid flow through a second valve configured to provide fluid flow through the second zone of the well is below the threshold, shuts off the other valves or requests the other valves to shut off to stop fluid flow through the other zones (zones one, three, four, and five) while maintaining fluid flow through the second valve.

The downhole fluid flow regulation system, after shutting off fluid flow through the other valves, injects a treatment substance (or requests a treatment substance to be injected) through the valve into the section of well. Continuing with the foregoing example, the downhole fluid flow regulation system, after shutting off fluid flow through valves that are fluidly coupled to zones one, three, four, and five, injects or request injection of a treatment substance through the second valve into zone two. In some embodiments, the downhole fluid flow regulation system is configured to determine, based on a fluid flow rate of the fluid flow through the valve, an amount and concentration of the treatment substance to inject into the valve. In some embodiments, the downhole fluid flow regulation system is also configured to determine, based on a treatment history of the plurality of valves, an amount and concentration of the treatment substance to inject into the valve.

After the treatment substance is injected, the downhole fluid flow regulation system re-opens the other valves while restricting fluid flow through the second valve for a threshold period of time (e.g., one hour, one day, or another period of time to provide the treatment substance sufficient time to treat the undesirable substance). Continuing with the foregoing example, the downhole fluid flow regulation system injects or requests a treatment substance to be injected into zone two, the downhole fluid flow regulation system re-opens the valves that are fluidly connected to zones one, three, four, and five, while shutting off the second valve for a threshold period of time to permit the treatment substance sufficient time to treat the undesirable substance from zone two. The downhole fluid flow regulation system then re-opens the valve (e.g., second valve) after the threshold period of time. In some embodiments, after fluid flow through the valve is restricted for the threshold period of time, the downhole fluid flow regulation system determines fluid flow through the valve (e.g., by temporarily opening the valve to test fluid flow through the valve). The downhole fluid flow regulation system (permanently) re-opens the valve after a determination that the fluid flow through the valve is at or above a second threshold flowrate. In one or more of such embodiments, in response to a determination that fluid flow through the valve is below the second threshold, the downhole fluid flow regulation system re-injects the treatment substance through the valve to treat the undesirable substance.

In some embodiments, the downhole fluid flow regulation system is configured to simultaneously or sequentially perform the operations described herein to inject treatment substances into multiple valves to treat the corresponding sections that are fluidly coupled to the valves. In one or more of such embodiments, the downhole fluid flow regulation system, in response to a determination that fluid flow through another valve (e.g., fourth valve of zone four) is below the threshold, maintains fluid flow through the fourth valve while restricting fluid flow through the other valves to fluidly isolate zone four. The downhole fluid flow regulation system injects the treatment substance through the fourth valve into zone four. After the treatment substance is injected through the fourth valve, the downhole fluid flow regulation system re-opens the other valves while restricting fluid flow through the fourth valve for a second threshold period of time. The downhole fluid flow regulation system then re-opens the fourth valve after the second threshold period of time. In some embodiments, the threshold period of time that different valves remain closed differ based on the amount of undesirable substance in the corresponding sections, the locations of the corresponding sections, properties of the valves, and other quantifiable downhole properties.

Although the foregoing paragraphs describe operations performed by the downhole fluid flow regulation system to determine fluid flow at a location, the downhole fluid flow regulation system is configured to simultaneously determine fluid flow at multiple locations. Similarly, although the foregoing paragraphs describe operations performed by the downhole fluid flow regulation system to determine the presence of a malfunctioning hardware, the downhole fluid flow regulation system is configured to simultaneously determine the presence of multiple malfunctioning hardware, such as multiple malfunctioning sensors and/or valves. Similarly, although the foregoing paragraphs describe operations performed by the downhole fluid flow regulation system to provide a recommendation to improve fluid flow, the downhole fluid flow regulation system is configured to simultaneously provide multiple recommendations to improve fluid flow at different locations, improve different aspects of a well operation, provide multiple forecasts of well operations of the well, and dynamically receive user inputs and configurations. Additional descriptions of the foregoing methods to regulate downhole fluid flow through a plurality of valves and downhole fluid flow regulation systems are described in the paragraphs below and are illustrated in FIGS. 1-5.

Turning now to the figures, FIG. 1 is a schematic, side view of a well environment 100 in which a downhole fluid flow regulation system 184 is deployed. As shown in FIG. 1, a wellbore 114 of well 102 extends from surface 108 of well 102 to or through formation 126. Downhole fluid flow regulation system 184 includes or is communicatively coupled to valves 103, 105, and 107 that are deployed in a well 102 and configured to control fluid flow through three zones 111C. 111B, and 111A, respectively.

A hook 138, cable 142, traveling block (not shown), and hoist (not shown) are provided to lower a conveyance 116 that is coupled to valves 103, 105, and 107 down wellbore 114 of well 102 or to lift conveyance 116 up from wellbore 114 of well 102. In one or more embodiments, conveyance 116 may be a drill string, drill pipe, wireline, slickline, coiled tubing, production tubing, downhole tractor or another type of conveyance operable to be deployed in wellbore 114. At a wellhead 106, an inlet conduit 122 is coupled to a fluid source 120 to provide fluids, such as treatment fluids (or fluids containing treatment substances) downhole. In the embodiment of FIG. 1, conveyance 116 has one or more internal cavities that provide fluid flow paths from surface 108 downhole to valves 103, 105, and 107. Conveyance 116 also has one or more return paths to permit fluids to flow out of zones 111C-111A via valves 103, 105, and 107 uphole through a diverter or an outlet conduit 128 and into a container 130 at wellhead 106.

In the embodiment of FIG. 1, downhole fluid flow regulation system 184 is configured to periodically and/or continuously monitor fluid flow through valves 103, 105, and 107. Downhole fluid flow regulation system 184 is also configured to request valves 103, 105, and 107 to turn on or shut off. Downhole fluid flow regulation system 184, in response to a determination that fluid flow through a valve (e.g., valve 105) is below a threshold, maintains fluid flow through valve 105 while restricting fluid flow through valves 103 and 107 to fluidly isolate zone 111B. Downhole fluid flow regulation system 184 then pumps fluids containing treatment substance down conveyance 116, and injects the treatment substance through valve 105 into zone 111B. After the treatment substance is injected, downhole fluid flow regulation system 184 requests valves 103 and 107 to re-open, and requests valve 105 to remain shut off to restrict fluid flow through valve 105 (into zone 111B) for a threshold period of time. Downhole fluid flow regulation system 184 then re-opens valve 105 after the threshold period of time. In some embodiments, downhole fluid flow regulation system 184 is configured to monitor the presence of undesirable substances, and request valves to open/shut off to perform additional treatment operations. For example, downhole fluid flow regulation system 184 is configured to monitor the presence of undesirable substance in zone 111B, and in response to a determination of an unacceptable level of undesirable substance in zone 111B, instruct valves 103, 105, and 107 to open/shut off for additional periods of time to treat zone 111B. In some embodiments, downhole fluid flow regulation system 184 is configured to control valves 103, 105, and 107 to simultaneously and/or consecutively inject treatment substances into multiple zones. In one or more of such embodiments, downhole fluid flow regulation system 184 varies the amount of time different valves that are fluidly connected to different zones are shut off based on the amount of undesirable substances to be treated.

Although FIG. 1 illustrates three valves 103, 105, and 107 that are fluidly coupled to three zones 111C, 111B, and 111A, respectively, in some embodiments, a different number of valves (not shown) are fluidly coupled to a different number of zones (not shown). In some embodiments, multiple valves are fluidly coupled to a single zone. Alternatively, in some embodiments, a single valve is configured to provide fluid flow through multiple zones. Although FIG. 1 illustrates downhole fluid flow regulation system 184 as having a surface-based processing component, in some embodiments, the processing component of downhole fluid flow regulation system 184 is located partially or completely downhole, or remote (e.g., in the cloud). Additional descriptions of valves 103, 105, and 107, and operations performed by downhole fluid flow regulation system 184 are provided herein and are illustrated in at least FIGS. 2-4.

Figure 2:
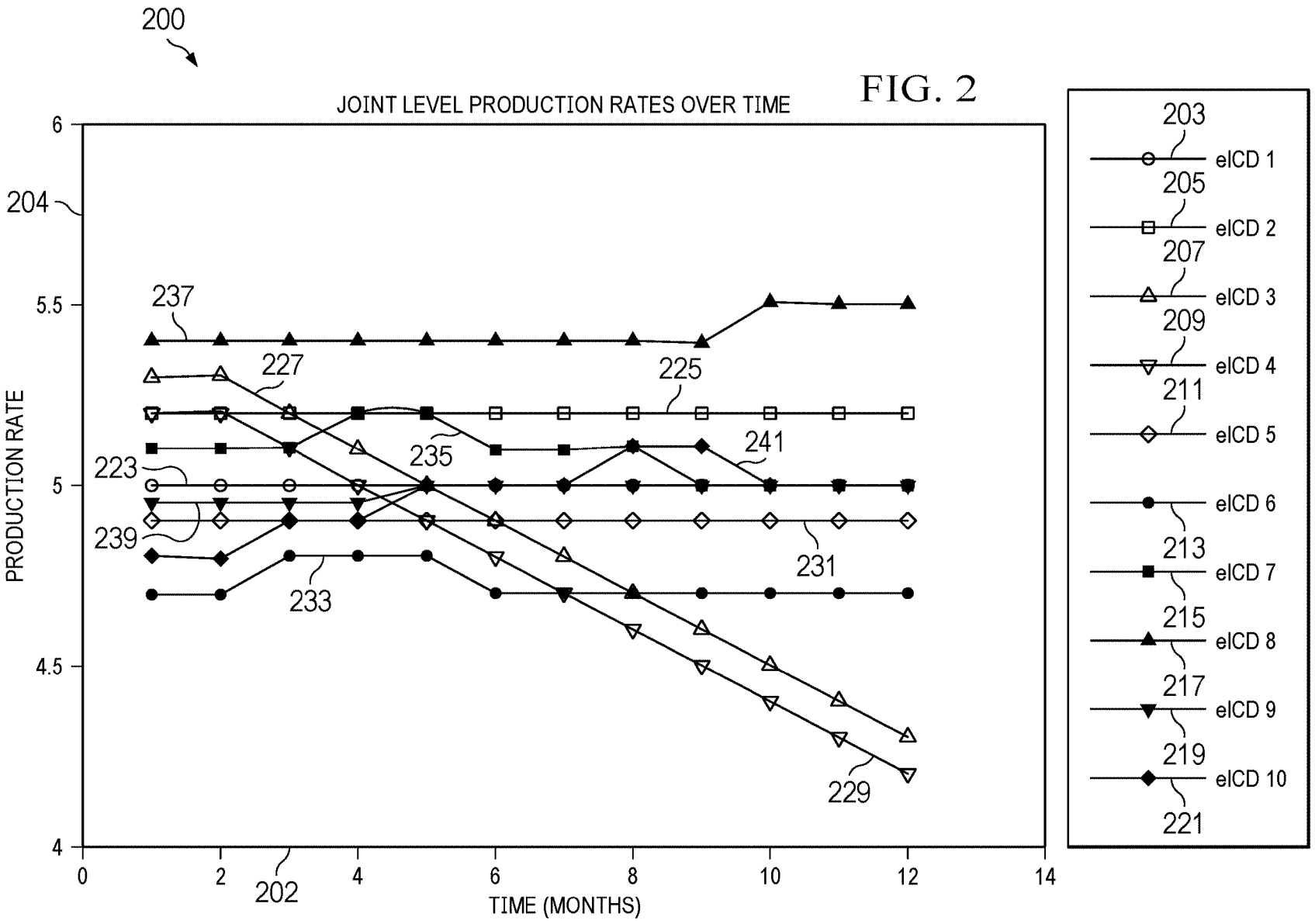
FIG. 2 is a plot of production rates at different sections of a wellbore over a period of time.

FIG. 2 is a plot 200 of production rates at different sections of a wellbore over a period of time. In the embodiment of FIG. 2, x-axis 202 represents time over a period of months, and y-axis 204 represents the production rate at joints (sections) of a wellbore having ten valves 203, 205, 207, 209, 211, 213, 215, 217, 219, and 221 that are configured to control fluid flow through ten different joints. In the embodiment of FIG. 2, lines 223, 225, 227, 229, 231, 233, 235, 237, 239, and 241 represent production at joints fluidly coupled to valves 203, 205, 207, 209, 211, 213, 215, 217, 219, and 221, respectively. As shown in FIG. 2, fluid flow through valves 207 and 209 has steadily decreased from the second month, which indicates a drop in production through the third section and fourth section, respectively. As described herein, downhole fluid flow regulation system is configured to perform the operations described herein and illustrated in FIGS. 3A-3C to improve fluid flow through the third and fourth sections.

Figure 3A:
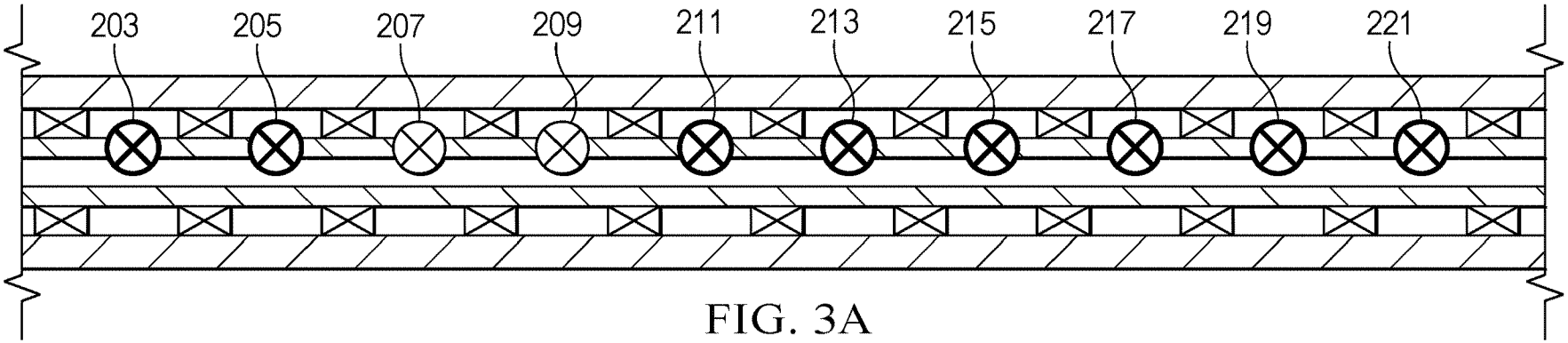
FIG. 3A is a schematic, cross-sectional view of ten sections of a wellbore, where valves configured to control fluid flow through the third and fourth sections remain on, while valves configured to control fluid flow through the other eight sections are shut off.
Figure 3B:
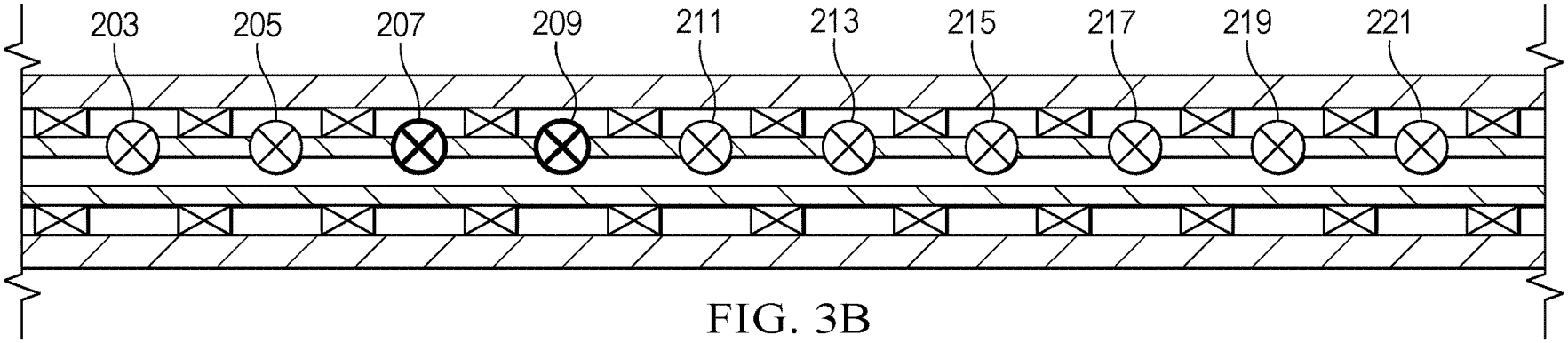
FIG. 3B is a schematic, cross-sectional view of the ten sections of a wellbore of FIG. 3A, where valves configured to control fluid flow through the third and fourth sections are shut off, while valves configured to control fluid flow through the other eight sections are re-opened.

FIG. 3A is a schematic, cross-sectional view of ten sections of a wellbore, where valves 207 and 209, which are configured to control fluid flow through the third and fourth sections remain on, while valves 203, 205, 211, 213, 215, 217, 219, and 221, which are configured to control fluid flow through the first, second, fifth, sixth, seventh, eighth, ninth, and tenth sections, respectively, are shut off. In that regard, the downhole fluid flow regulation system in response to a determination that fluid flow through valves 207 and 209 is below a threshold flowrate, initiates an operation to treat the third and fourth sections by first shutting off fluid flow through valves 203, 205, 211, 213, 215, 217, 219, and 221. The downhole fluid flow regulation system then pumps treatment fluids containing treatment substances or instructs the treatment fluids to be pumped through valves 207 and 209 to remove and/or treat buildup of undesirable substances. After the treatment fluids are pumped through valves 207 and 209, the downhole fluid flow regulation system shuts off valves 207 and 209 for a threshold period of time to permit the treatment fluids to remove and/or treat buildup of undesirable substances. The downhole fluid flow regulation system also re-opens valves 203, 205, 211, 213, 215, 217, 219, and 221 to permit production in the first, second, fifth, sixth, seventh, eighth, ninth, and tenth sections, respectively. In that regard, FIG. 3B is a schematic, cross-sectional view of the ten sections of a wellbore of FIG. 3A, where valves 207 and 209 which are configured to control fluid flow through the third and fourth sections are shut off, while valves 203, 205, 211, 213, 215, 217, 219, and 221 which configured to control fluid flow through the first, second, fifth, sixth, seventh, eighth, ninth, and tenth sections are re-opened. In some embodiments, the amount of time valves 207 and 209 are shut off depends on the flow rate through valves 207 and 209, respectively prior to the shut off of the respective valves. In some embodiments, the amount of time valves 207 and 209 are shut off depends on the amount of undesirable substances present in the third and fourth sections, respectively. In some embodiments, valves 207 and 209 are shut off for different amounts of times. In some embodiments, one of valves 207 and 209 are re-opened to pump additional treatment fluids into the respective valve, and the valve is shut off again until the fluid flowrate through the respective valves improves (to above the threshold flowrate).

Figure 3C:
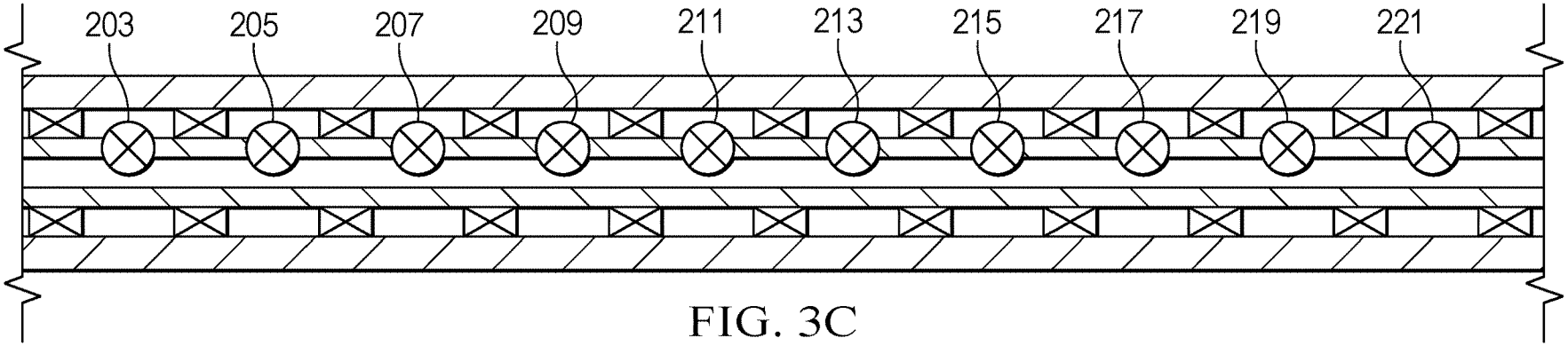
FIG. 3C is a schematic, cross-sectional view of the ten sections of FIG. 3B after the valves configured to control fluid flow through the third section and the fourth section are re-opened.

The downhole fluid flow regulation system re-opens valves 207 and 209 after the fluid flowrate through valves 207 and 209 improves to above the threshold flowrate, and initiates production operations in the third and fourth sections. In that regard, FIG. 3C is a schematic, cross-sectional view of the ten sections of FIG. 3B after valves 207 and 209, which are configured to control fluid flow through the third section and the fourth section, respectively, are re-opened to continue production through all ten sections. The downhole fluid flow regulation system continues to periodically and/or continuously monitor fluid flow through 203, 205, 207, 209, 211, 213, 215, 217, 219, and 221, and performs operations described herein in response to a subsequent determination that fluid flow through one or more of valves 203, 205, 207, 209, 211, 213, 215, 217, 219, and 221 dip below the threshold flowrate.

Figure 4:
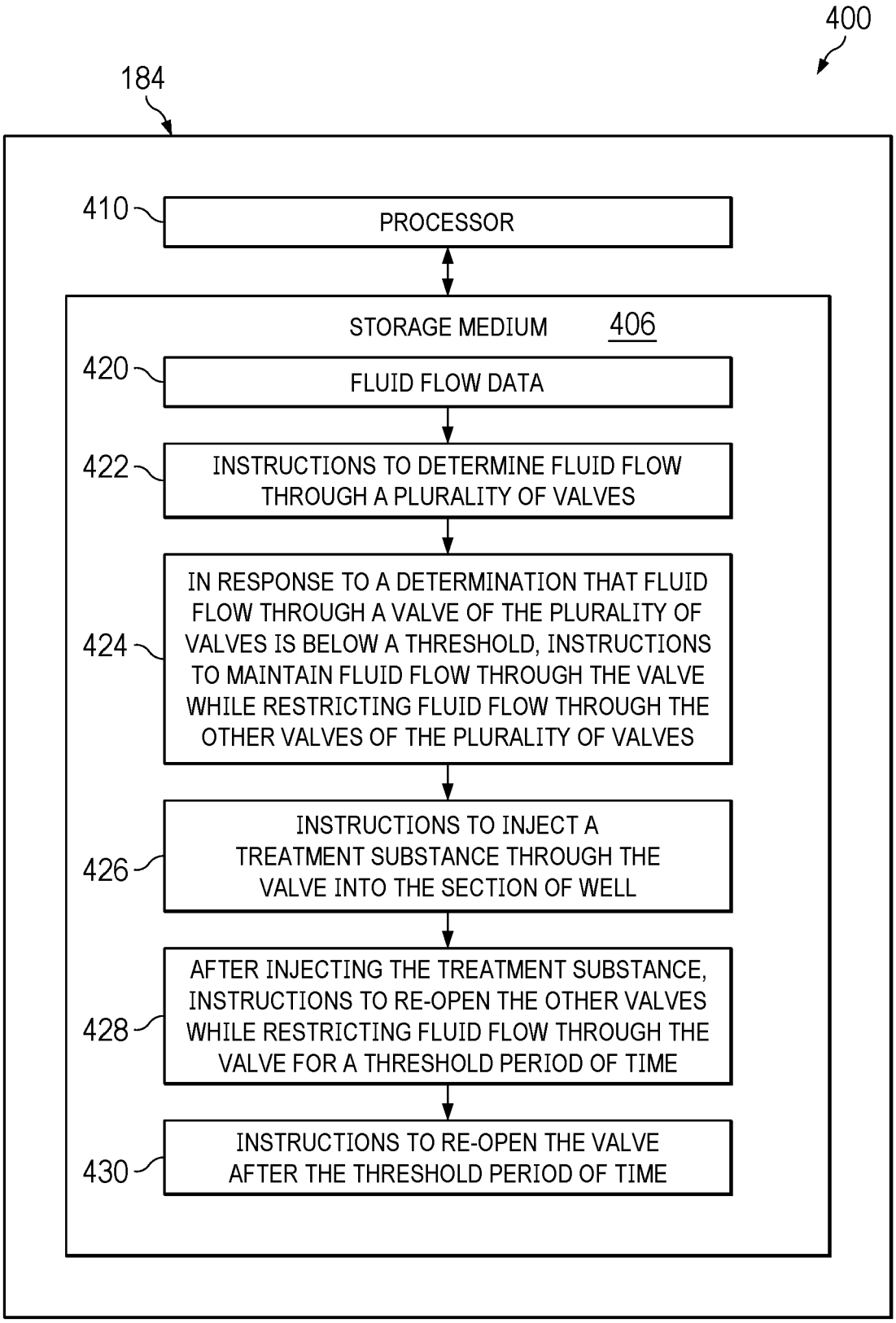
FIG. 4 is a block diagram of the downhole fluid flow regulation system of FIG. 1.
Figure 5:
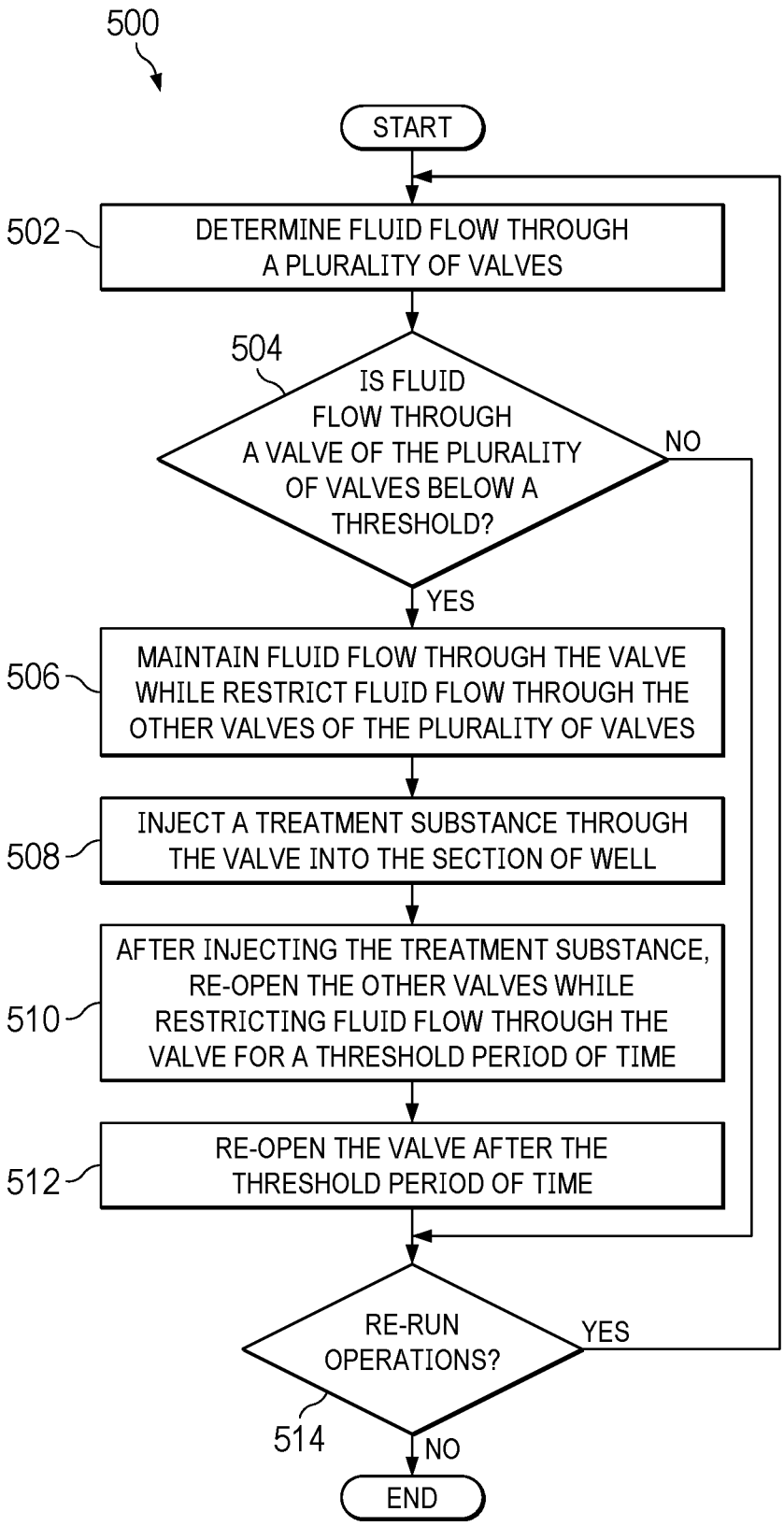
FIG. 5 is a flow chart of a process to regulate downhole fluid flow.

FIG. 4 is a block diagram 400 of the downhole fluid flow regulation system 184 of FIG. 1, and that is configured to perform the operations illustrated in process 500 of FIG. 5. Downhole fluid flow regulation system 400 includes a storage medium 406 and a processor 410. The storage medium 406 may be formed from data storage components such as, but not limited to, read-only memory (ROM), random access memory (RAM), flash memory, magnetic hard drives, solid state hard drives, CD-ROM drives, DVD drives, floppy disk drives, as well as other types of data storage components and devices. In some embodiments, the storage medium 406 includes multiple data storage devices. In further embodiments, the multiple data storage devices may be physically stored at different locations. In one of such embodiments, the data storage devices are components of a server station, such as a cloud server. Fluid flow data indicative of flow through one or more valves and through sections associated with the one or more valves (collectively "well data") are stored at a first location 420 of storage medium 406. Further, instructions to determine fluid flow through a plurality of valves are stored at a second location 422 of storage medium 406. Further, in response to a determination that fluid flow through a valve of the plurality of valves is below a threshold, instructions to maintain fluid flow through the valve while restricting fluid flow through the other valves of the plurality of valves are stored at a third location 424 of storage medium 406. Further, instructions to inject a treatment substance through the valve into the section of the well are stored at a fourth location 426 of storage medium 406. Further, after injecting the treatment substance, instructions to re-open the other valves while restricting fluid flow through the valve for a threshold period of time are stored at a fifth location 428 of storage medium 406. Further, instructions to re-open the valve after the threshold period of time are stored at a sixth location 430 of storage medium 406.

FIG. 5 is a flow chart of a process 500 to regulate downhole fluid flow. Although the operations in process 500 are shown in a particular sequence, certain operations may be performed in different sequences or at the same time where feasible.

At block 502, fluid flow through a plurality of valves are determined. For example, the downhole fluid flow regulation system determines the flowrate of fluid flow through valves 203, 205, 207, 209, 211, 213, 215, 217, 219, and 221 of FIGS. 3A-3C. At block 504, a determination of whether fluid flow through a valve of the plurality of valves is below a threshold. In the embodiment of FIGS. 3A-3C, the downhole fluid flow regulation system determines that fluid flow through valves 207 and 209 are below the threshold flowrate. In some embodiments, the downhole fluid flow regulation system determines fluid flow over a threshold period of time for each valve, where fluid flow through the valve is below the threshold if fluid flow through the valve over the threshold period of time is below the threshold.

Process 500 proceeds from block 504 to block 514 in response to a determination that fluid flow through all of the valves of the plurality of valves are greater than or equal to a threshold. Alternatively, and in response to a determination that fluid flow through a valve of the plurality of valves is below the threshold, process 500 proceeds to block 506, and the downhole fluid flow regulation system maintains fluid flow through the valve while restricting fluid flow through the other valves of the plurality of valves. FIG. 3A, for example, illustrates valves 207 and 209 are in open positions while valves 203, 205, 211, 213, 215, 217, 219, and 221 are shut off. At block 508, a treatment substance is injected through the valve into the section of well. In the embodiment of FIG. 3A, treatment fluids containing treatment substance are injected into valves 207 and 209 while valves 203, 205, 211, 213, 215, 217, 219, and 221 are shut off.

At block 510, and after injecting the treatment substance, the downhole fluid flow regulation system re-opens the other valves while restricting fluid flow through the valve for a threshold period of time. In that regard, FIG. 3B illustrates valves 207 and 209 being shut off while valves 203, 205, 211, 213, 215, 217, 219, and 221 are re-opened to permit production operations in the first, second, fifth, sixth, seventh, eighth, ninth, and tenths sections while the third and fourth sections are treated by the treatment substance. At block 512, the downhole fluid flow regulation system re-opens the valve after the threshold period of time. FIG. 3C, for example, illustrates valves 207 and 209 being re-opened after the threshold period of time to permit production operations to commence in the third and fourth zones. In some embodiments, after restricting fluid flow through the valve for the threshold period of time, the downhole fluid flow regulation system determines fluid flow through the valve, and re-opens the valve after a determination that the fluid flow through the valve is at or above a second threshold. In one or more of such embodiments, the first fluid flow threshold and the second fluid flow threshold are different. In some embodiments, the downhole fluid flow regulation system in response to a determination that fluid flow through the valve is below the second threshold, re-injects the treatment substance through the valve. In one or more of such embodiments, the downhole fluid flow regulation system continues to periodically re-inject the treatment substance through the valve until fluid flow through the valve improves to at least the second threshold.

Process 500 then proceeds to block 514, and the downhole fluid flow regulation system determines whether to re-run operations described herein to regulate downhole fluid flow. Process 500 then returns to block 502 in response to a determination to re-run the operations. Alternatively, process 500 ends (or temporarily ends) in response to a determination not to re-run the operations. In some embodiments, some of the blocks of process 500 are concurrently performed to concurrently improve production through different sections of a wellbore.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a computer-implemented method to regulate downhole fluid flow through a plurality of valves, comprising: determining fluid flow through a plurality of valves; in response to a determination that fluid flow through a valve of the plurality of valves is below a threshold: maintaining fluid flow through the valve while restricting fluid flow through other valves of the plurality of valves to fluidly isolate a section of a well that is fluidly connected to the valve from other sections of the well that are fluidly connected to the other valves, wherein the other valves are valves of the plurality of valves having fluid flows at or above the threshold; injecting a treatment substance through the valve into the section of well; after injecting the treatment substance, re-opening the other valves while restricting fluid flow through the valve for a threshold period of time; and re-opening the valve after the threshold period of time.

Clause 2, the computer-implemented method of clause 1, wherein determining fluid flow through the plurality of valves comprises determining fluid flow over a threshold period of time for each valve of the plurality of valves, wherein fluid flow through the valve is below the threshold if fluid flow through the valve over the threshold period of time is below the threshold.

Clause 3, the computer-implemented method of clauses 1 or 2, further comprising: after restricting fluid flow through the valve for the threshold period of time, determining fluid flow through the valve; and re-opening the valve after a determination that the fluid flow through the valve is at or above a second threshold.

Clause 4, the computer-implemented method of clause 3, further comprising: in response to a determination that fluid flow through the valve is below the second threshold, re-injecting the treatment substance through the valve.

Clause 5, the computer-implemented method of any of clauses 1-4, further comprising: in response to a determination that fluid flow through a second valve of the plurality of valves is below the threshold: maintaining fluid flow through the second valve while restricting fluid flow through the other valves to fluidly isolate a second section of a well that is fluidly connected to the second valve from other sections of the well that are fluidly connected to the other valves; injecting the treatment substance through the second valve into the second section of well; after injecting the treatment substance, re-opening the other valves while restricting fluid flow through the second valve for a second threshold period of time; and re-opening the second valve after the second threshold period of time.

Clause 6, the computer-implemented method of clause 5, wherein the first threshold period of time and the second threshold period of time are different, and wherein the first valve and the second valve are opened at different times.

Clause 7, the computer-implemented method of any of clauses 1-6, further comprising: after re-opening the valve, re-determining fluid flow through a plurality of valves; in response to a second determination that fluid flow through a second valve of the plurality of valves is below the threshold: maintaining fluid flow through the second valve while restricting fluid flow through the other valves of the plurality of valves to fluidly isolate a second section of the well that is fluidly connected to the second valve from the other sections of the well that are fluidly connected to the other valves; injecting the treatment substance through the second valve into the second section of well; after injecting the treatment substance, re-opening the other valves while restricting fluid flow through the second valve for a second threshold period of time; and re-opening the second valve after the second threshold period of time.

Clause 8, the computer-implemented method of any of clauses 1-7, further comprising: determining, based on a fluid flow rate of the fluid flow through the valve, an amount and concentration of the treatment substance to inject into the valve.

Clause 9, the computer-implemented method of any of clauses 1-8, further comprising: determining, based on a treatment history of the plurality of valves, an amount and concentration of the treatment substance to inject into the valve.

Clause 10, a downhole fluid flow regulation system comprising: a plurality of valves positioned along different joints of a well; a storage medium; and one or more processors configured to: determine fluid flow through a plurality of valves; in response to a determination that fluid flow through a valve of the plurality of valves is below a threshold: maintain fluid flow through the valve while restricting fluid flow through other valves of the plurality of valves to fluidly isolate a section of a well that is fluidly connected to the valve from other sections of the well that are fluidly connected to the other valves, wherein the other valves are valves of the plurality of valves having fluid flows at or above the threshold; inject a treatment substance through the valve into the section of well; after the treatment substance is injected, re-open the other valves while restricting fluid flow through the valve for a threshold period of time; and re-open the valve after the threshold period of time.

Clause 11, the downhole fluid flow regulation system of clause 10, wherein the one or more processors are further configured to: determine fluid flow through the plurality of valves comprises determining fluid flow over a threshold period of time for each valve of the plurality of valves, wherein fluid flow through the valve is below the threshold if fluid flow through the valve over the threshold period of time is below the threshold.

Clause 12, downhole fluid flow regulation system of clauses 10 or 11, wherein the one or more processors are further configured to: after fluid flow through the valve is restricted for the threshold period of time, determine fluid flow through the valve; and re-open the valve after a determination that the fluid flow through the valve is at or above a second threshold.

Clause 13, the downhole fluid flow regulation system of clause 12, wherein the one or more processors are further configured to: in response to a determination that fluid flow through the valve is below the second threshold, re-inject the treatment substance through the valve.

Clause 14, the downhole fluid flow regulation system of any of clauses 10-13, wherein the one or more processors are further configured to: in response to a determination that fluid flow through a second valve of the plurality of valves is below the threshold: maintain fluid flow through the second valve while restricting fluid flow through the other valves to fluidly isolate a second section of a well that is fluidly connected to the second valve from other sections of the well that are fluidly connected to the other valves; inject the treatment substance through the second valve into the second section of well; after the treatment substance is injected through the second valve, re-open the other valves while restricting fluid flow through the second valve for a second threshold period of time; and re-open the second valve after the second threshold period of time.

Clause 15, the downhole fluid flow regulation system of clause 14, wherein the first threshold period of time and the second threshold period of time are different, and wherein the first valve and the second valve are opened at different times.

Clause 16, the downhole fluid flow regulation system of any of clauses 10-15, wherein the one or more processors are further configured to: after the valve is reopened, re-determine fluid flow through a plurality of valves; in response to a second determination that fluid flow through a second valve of the plurality of valves is below the threshold: maintain fluid flow through the second valve while restricting fluid flow through the other valves of the plurality of valves to fluidly isolate a second section of the well that is fluidly connected to the second valve from the other sections of the well that are fluidly connected to the other valves; inject the treatment substance through the second valve into the second section of well; after the treatment substance is injected through the second valve, re-open the other valves while restricting fluid flow through the second valve for a second threshold period of time; and re-open the second valve after the second threshold period of time.

Clause 17, the downhole fluid flow regulation system of any of clauses 10-16, wherein the one or more processors are further configured to: determine, based on a fluid flow rate of the fluid flow through the valve, an amount and concentration of the treatment substance to inject into the valve.

Clause 18, the downhole fluid flow regulation system of any of clauses 10-17, wherein the one or more processors are further configured to: determine, based on a treatment history of the plurality of valves, an amount and concentration of the treatment substance to inject into the valve.

Clause 19, a non-transitory storage medium, comprising instructions, which when executed by a processor, cause the processor to perform operations comprising: determining fluid flow through a plurality of valves; in response to a determination that fluid flow through a valve of the plurality of valves is below a threshold: maintaining fluid flow through the valve while restricting fluid flow through other valves of the plurality of valves to fluidly isolate a section of a well that is fluidly connected to the valve from other sections of the well that are fluidly connected to the other valves, wherein the other valves are valves of the plurality of valves having fluid flows at or above the threshold; injecting a treatment substance through the valve into the section of well; after injecting the treatment substance, re-opening the other valves while restricting fluid flow through the valve for a threshold period of time; and re-opening the valve after the threshold period of time; after re-opening the valve, re-determining fluid flow through a plurality of valves; in response to a second determination that fluid flow through a second valve of the plurality of valves is below the threshold: maintaining fluid flow through the second valve while restricting fluid flow through the other valves of the plurality of valves to fluidly isolate a second section of the well that is fluidly connected to the second valve from the other sections of the well that are fluidly connected to the other valves; injecting the treatment substance through the second valve into the second section of well; after injecting the treatment substance, re-opening the other valves while restricting fluid flow through the second valve for a second threshold period of time; and re-opening the second valve after the second threshold period of time.

Clause 20, the non-transitory storage medium of clause 19, wherein the instructions, when executed by a processor, cause the processor to perform operations comprising: determining, based on at least one of a fluid flow rate of the fluid flow through the valve and a treatment history of the plurality of valves, an amount and concentration of the treatment substance to inject into the valve.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A computer-implemented method to regulate downhole fluid flow through a plurality of valves, comprising:

determining fluid flow through a plurality of valves;

in response to a determination that fluid flow through a valve of the plurality of valves is below a threshold due to particle buildup:

maintaining fluid flow through the valve while restricting production fluid flow through other valves of the plurality of valves to fluidly isolate a section of a well that is fluidly connected to the valve from other sections of the well that are fluidly connected to the other valves, wherein the other valves are valves of the plurality of valves having production fluid flows at or above the threshold;

injecting a treatment substance through the valve into the section of well;

after injecting the treatment substance, re-opening the other valves for production flow while restricting fluid flow through the valve for a threshold period of time;

after restricting fluid flow through the valve for the threshold period of time, determining fluid flow through the valve; and re-opening the valve after a determination that the fluid flow through the valve is at or above a second threshold.

2. The computer-implemented method of claim 1, wherein determining fluid flow through the plurality of valves comprises determining fluid flow over a threshold period of time for each valve of the plurality of valves, wherein fluid flow through the valve is below the threshold if fluid flow through the valve over the threshold period of time is below the threshold.

3. The computer-implemented method of claim 1, further comprising:

in response to a determination that fluid flow through the valve is below the second threshold, re-injecting the treatment substance through the valve.

4. The computer-implemented method of claim 1, further comprising:

in response to a determination that fluid flow through a second valve of the plurality of valves is below the threshold:

maintaining fluid flow through the second valve while restricting fluid flow through the other valves to fluidly isolate a second section of a well that is fluidly connected to the second valve from other sections of the well that are fluidly connected to the other valves;

injecting the treatment substance through the second valve into the second section of well;

after injecting the treatment substance, re-opening the other valves while restricting fluid flow through the second valve for a second threshold period of time; and re-opening the second valve after the second threshold period of time.

5. The computer-implemented method of claim 4, wherein the first threshold period of time and the second threshold period of time are different, and wherein the first valve and the second valve are opened at different times.

6. The computer-implemented method of claim 1, further comprising:

after re-opening the valve, re-determining fluid flow through a plurality of valves;

in response to a second determination that fluid flow through a second valve of the plurality of valves is below the threshold:

maintaining fluid flow through the second valve while restricting fluid flow through the other valves of the plurality of valves to fluidly isolate a second section of the well that is fluidly connected to the second valve from the other sections of the well that are fluidly connected to the other valves;

injecting the treatment substance through the second valve into the second section of well;

after injecting the treatment substance, re-opening the other valves while restricting fluid flow through the second valve for a second threshold period of time; and re-opening the second valve after the second threshold period of time.

7. The computer-implemented method of claim 1, further comprising:

determining, based on a fluid flow rate of the fluid flow through the valve, an amount and concentration of the treatment substance to inject into the valve.

8. The computer-implemented method of claim 1, further comprising:

determining, based on a treatment history of the plurality of valves, an amount and concentration of the treatment substance to inject into the valve.

9. A downhole fluid flow regulation system comprising:

a plurality of valves positioned along different joints of a well;

a storage medium; and one or more processors configured to:

determine fluid flow through a plurality of valves;

in response to a determination that fluid flow through a valve of the plurality of valves is below a threshold due to particle buildup:

maintain fluid flow through the valve while restricting production fluid flow through other valves of the plurality of valves to fluidly isolate a section of a well that is fluidly connected to the valve from other sections of the well that are fluidly connected to the other valves, wherein the other valves are valves of the plurality of valves having production fluid flows at or above the threshold;

inject a treatment substance through the valve into the section of well;

after the treatment substance is injected, re-open the other valves for production flow while restricting fluid flow through the valve for a threshold period of time;

after restricting fluid flow through the valve for the threshold period of time, determining fluid flow through the valve; and re-opening the valve after a determination that the fluid flow through the valve is at or above a second threshold.

10. The downhole fluid flow regulation system of claim 9, wherein the one or more processors are further configured to:

determine fluid flow through the plurality of valves comprises determining fluid flow over a threshold period of time for each valve of the plurality of valves, wherein fluid flow through the valve is below the threshold if fluid flow through the valve over the threshold period of time is below the threshold.

11. The downhole fluid flow regulation system of claim 9, wherein the one or more processors are further configured to:

in response to a determination that fluid flow through the valve is below the second threshold, re-inject the treatment substance through the valve.

12. The downhole fluid flow regulation system of claim 9, wherein the one or more processors are further configured to:

in response to a determination that fluid flow through a second valve of the plurality of valves is below the threshold:

maintain fluid flow through the second valve while restricting fluid flow through the other valves to fluidly isolate a second section of a well that is fluidly connected to the second valve from other sections of the well that are fluidly connected to the other valves;

inject the treatment substance through the second valve into the second section of well;

after the treatment substance is injected through the second valve, re-open the other valves while restricting fluid flow through the second valve for a second threshold period of time; and re-open the second valve after the second threshold period of time.

13. The downhole fluid flow regulation system of claim 12, wherein the first threshold period of time and the second threshold period of time are different, and wherein the first valve and the second valve are opened at different times.

14. The downhole fluid flow regulation system of claim 9, wherein the one or more processors are further configured to:

after the valve is reopened, re-determine fluid flow through a plurality of valves;

in response to a second determination that fluid flow through a second valve of the plurality of valves is below the threshold:

maintain fluid flow through the second valve while restricting fluid flow through the other valves of the plurality of valves to fluidly isolate a second section of the well that is fluidly connected to the second valve from the other sections of the well that are fluidly connected to the other valves;

inject the treatment substance through the second valve into the second section of well;

after the treatment substance is injected through the second valve, re-open the other valves while restricting fluid flow through the second valve for a second threshold period of time; and re-open the second valve after the second threshold period of time.

15. The downhole fluid flow regulation system of claim 9, wherein the one or more processors are further configured to:

determine, based on a fluid flow rate of the fluid flow through the valve, an amount and concentration of the treatment substance to inject into the valve.

16. The downhole fluid flow regulation system of claim 9, wherein the one or more processors are further configured to:

determine, based on a treatment history of the plurality of valves, an amount and concentration of the treatment substance to inject into the valve.

17. A non-transitory storage medium, comprising instructions that cause a processor to perform operations comprising:

determining fluid flow through a plurality of valves;

in response to a determination that fluid flow through a valve of the plurality of valves is below a threshold due to particle buildup:

maintaining fluid flow through the valve while restricting fluid production flow through other valves of the plurality of valves to fluidly isolate a section of a well that is fluidly connected to the valve from other sections of the well that are fluidly connected to the other valves, wherein the other valves are valves of the plurality of valves having production fluid flows at or above the threshold;

injecting a treatment substance through the valve into the section of well;

after injecting the treatment substance, re-opening the other valves for production flow while restricting fluid flow through the valve for a threshold period of time; and re-opening the valve after the threshold period of time;

after re-opening the valve, re-determining fluid flow through a plurality of valves;

in response to a second determination that fluid flow through a second valve of the plurality of valves is below the threshold:

maintaining fluid flow through the second valve while restricting production fluid flow through the other valves of the plurality of valves to fluidly isolate a second section of the well that is fluidly connected to the second valve from the other sections of the well that are fluidly connected to the other valves;

injecting the treatment substance through the second valve into the second section of well;

after injecting the treatment substance, re-opening the other valves for production flow while restricting fluid flow through the second valve for a second threshold period of time; and re-opening the second valve after the second threshold period of time.

18. The non-transitory storage medium of claim 17, wherein the instructions, when executed by a processor, cause the processor to perform operations comprising:

determining, based on at least one of a fluid flow rate of the fluid flow through the valve and a treatment history of the plurality of valves, an amount and concentration of the treatment substance to inject into the valve.

19. The non-transitory storage medium of claim 17, wherein the instructions, when executed by a processor, cause the processor to perform operations comprising:

in response to a determination that fluid flow through the valve is below the second threshold, re-injecting the treatment substance through the valve.

20. The non-transitory storage medium of claim 17, wherein the instructions, when executed by a processor, cause the processor to perform operations comprising:

wherein the first threshold period of time and the second threshold period of time are different, and wherein the first valve and the second valve are opened at different times.

* * * * *